United States Patent [19]

Blackmore

[11] Patent Number: 4,570,428

[45] Date of Patent: Feb. 18, 1986

[54] TWIN TRACK BUNCHER

[75] Inventor: Andrew Blackmore, King City, Canada

[73] Assignee: Ceeco Machinery Manufacturing Limited, Concord, Ontario, Canada

[21] Appl. No.: 602,667

[22] Filed: Apr. 23, 1984

[51] Int. Cl.[4] ..... D07B 3/10; D01H 7/86

[52] U.S. Cl. ..... 57/58.65; 57/58.52; 57/58.55; 57/58.67; 57/58.7

[58] Field of Search ..... 57/58.52–58.57, 57/58.65, 58.67, 58.68, 58.7

[56] References Cited

U.S. PATENT DOCUMENTS

| | | | |
|---|---|---|---|
| 3,147,581 | 9/1964 | Godderidge | 57/58.65 X |
| 4,328,662 | 5/1982 | Bretegnier et al. | 57/58.65 X |
| 4,339,909 | 7/1982 | Godderidge | 57/58.67 X |

*Primary Examiner*—John Petrakes

*Attorney, Agent, or Firm*—Lilling & Greenspan

[57] ABSTRACT

An "outside-in" double twist bow buncher includes a cradle which supports two wire receiving bobbins. Wire guides are provided at both axial ends of the machine for receiving and guiding two separate groups of wires and, with a traverse mechanism, laying each group of wires onto a respective bobbin.

14 Claims, 7 Drawing Figures

TWIN TRACK BUNCHER

BACKGROUND OF THE INVENTION

The invention relates to wire machinery, and more specifically to an "outside-in" double twist bow buncher for simultaneously twisting two sets of wires or strands and winding each set onto one of two bobbins arranged in the machine.

Machines sometimes denominated as stranders, bow stranders, twisters, double twist twister, pairing machines, double twist stranders, twinners, cablers, bunchers, and double twist bunchers have been in existence for over thirty years. Subsequently referred to as "double twist bunchers", these machines are used to combine a plurality of individual strands of wires and bunch them together by imparting a double twist to them.

Typically, the individual strands or wires are payed off a plurality of bobbins and directed to the input end at one axial end of the machine. The wires are all grouped or bunched together at a closing point prior to the entry of the machine. The wires are all grouped or bunched together at a closing point prior to the entry of the machine. The closing point remains fixed relative to the main structure of the machine. The bunched wires or strands are then introduced into one end of a bow which rotates about the longitudinal axis of the machine. It is this rotation of the bow that imparts a first twist to the bunched wires. Leaving the bow at the other end, the bunched and now single twisted wires pass over a second, exit pulley or sheave, which rotates with the bow. From this rotating sheave the bunched wire is directed over a sheave that is mounted on a cradle that is stationary in relation to the frame of the machine. A second twist is imparted to the wire between the last sheave mounted on the bow and the first sheave attached to the cradle. Additional pulleys disposed within the space defined by the rotating bow, guide the now double twisted bunched wires to the stationary bobbin supported within the machine and wound on the bobbin while being evenly distributed thereon. Depending on the machine, slightly different wire guiding system arrangements have been used.

Double twist bunchers have been extensively used in the electrical wire and cable, steel tire cord and steel rope industries for decades.

In some cases, wires or strands from an external multiple pay-off are guided into the machine, twisted and laid on a bobbin disposed inside the strander ("outside-in" machine). In other cases, multiple bobbins are arranged inside the buncher which form a multiple pay-off, and the wires or strands are drawn off the bobbins, twisted and wound onto an external bobbin ("inside-out" machine). Typical machines are illustrated in the Electrical Wire and Cable Machinery brochure, published by Ceeco Machinery Manufacturing Co., Inc., the assignee of the subject application. Other exemplary structures of existing machines are disclosed in U.S. Pat. Nos. 3,570,234 and 3,732,682.

The existing machines have used diametrically opposite double bow arrangements or counterbalanced bows. A machine which uses counter-balanced bows is manufactured, for example, by Lesmo of Milano, Italy. Although the wires or strands only pass through one of the bows, the other bow is generally provided only to balance the wire-carrying or operative bow. Aside from the dynamic balancing of the system, the non-operative bow has not, up to now, been used for any other function or purpose.

Existing double twist bunchers have generally performed satisfactorily and have produced the desired product. However, each such machine has always introduced or removed the wires or strands through only one axial end of the machine.

Also, all "outside-in" machines have always wound wire onto a single bobbin disposed inside the machine. Because all wires and strands have always been introduced through only one axial end of the machine, these wires could not be distributed onto two separate bobbins since the wires or strands are immediately all twisted together when introduced into the machine.

Therefore, in order to increase production and wind additional bobbins it has been necessary to utilize a plurality of such double twist bunchers. This, of course, has entailed additional expense, and additional floor space. Since each machine is self-contained and capable of operating independently, drive components and controls must correspondingly be multiplied. Existing double twist bunchers have not heretofore shared drives or controls.

SUMMARY OF THE INVENTION

In view of the aforementioned disadvantages inherent in the prior "outside-in" art double twist bunchers, it is an object of the present invention to provide such a machine for imparting a double twist to a plurality of wires or strands which does not have the disadvantages inherent in the conventional machines.

It is another object of the present invention to provide an improved wire twisting machine which utilizes, to a substantial extent, the design features of conventional double twist bunchers and which can be used substantially in the same way as the prior machines.

It is still another object of the present invention to provide a double twist buncher "outside-in" machine for twisting wires or strands which utilizes each of the bows as a guide for guiding two separate groups of wires or strands introduced at opposite ends of the machine for twisting and winding the same onto two separate reels or bobbins dispersed within the machine. This is not to say, however, that both sets of wires or strands cannot be run on the same bow. It is simply convenient to use the idle bow for this purpose.

It is yet another object of the present invention to provide a double twist buncher as above suggested which substantially increases the production capabilities of the machine without significantly increasing the cost thereof.

It is a further object of the present invention to provide a machine of the type under discussion which is capable of substantially increasing the production of the machine without significantly increasing the size of the machine.

It is still a further object of the present invention to provide a bow strander or twister which is simple in design and economical to manufacture.

It is yet a further object of the present invention to include the flexibility of providing a product with the same handing or twist direction to include counter rotating bows.

It is yet a further object of the present invention to provide the flexibility of running two separate and discrete products simultaneously (i.e. with different lay lengths).

It is yet a further object of the present invention to provide an "outside-in" double twist buncher which allows substantial economies by introducing two bobbins or reels within the machine which share some of the common mechanical and electrical systems and controls which would normally be used in connection with only one reel or bobbin bow strander.

It is an additional object of the present invention to provide a bow strander which is more efficient in the utilization of drive and control mechanisms and in the utilization of floor space for a given level of production.

In order to achieve the above objects, as well as others which will become apparent hereafter, a twin bobbin double twist buncher in accordance with the present invention includes inlet guide means at each axial end of a bow strander or twister which accepts another group of wires or strands. Each group of wires or strands are twisted by another one of two wire carrier means in the nature of bows and subsequently wound onto one of two reels disposed or supported within the machine. This is not to say that both sets of wires cannot be run on the same bow. It is simply convenient to use the idle bow provided on many conventional bow-type machines for this purpose. The axes of the two bobbins or reels may be oriented in any position relative to the axis of the twister. The most common configurations include the orientation where the axis of both bobbins or reels are coaxial with the axis of the machine or alternatively, perpendicular to the axis of the machine. In either case, an individual traverse or a common traverse may be used to distribute the bunched wires or strands across the surface of the reel or bobbin.

BRIEF DESCRIPTION OF THE INVENTION

The invention, together with additional objects and advantages thereof, will best be understood from the Description of the Preferred Embodiments, when read in connection with the accompanying drawings, in which.

DESCRIPTION OF THE PREFERRED EMBODIMENTS

Figure 1:
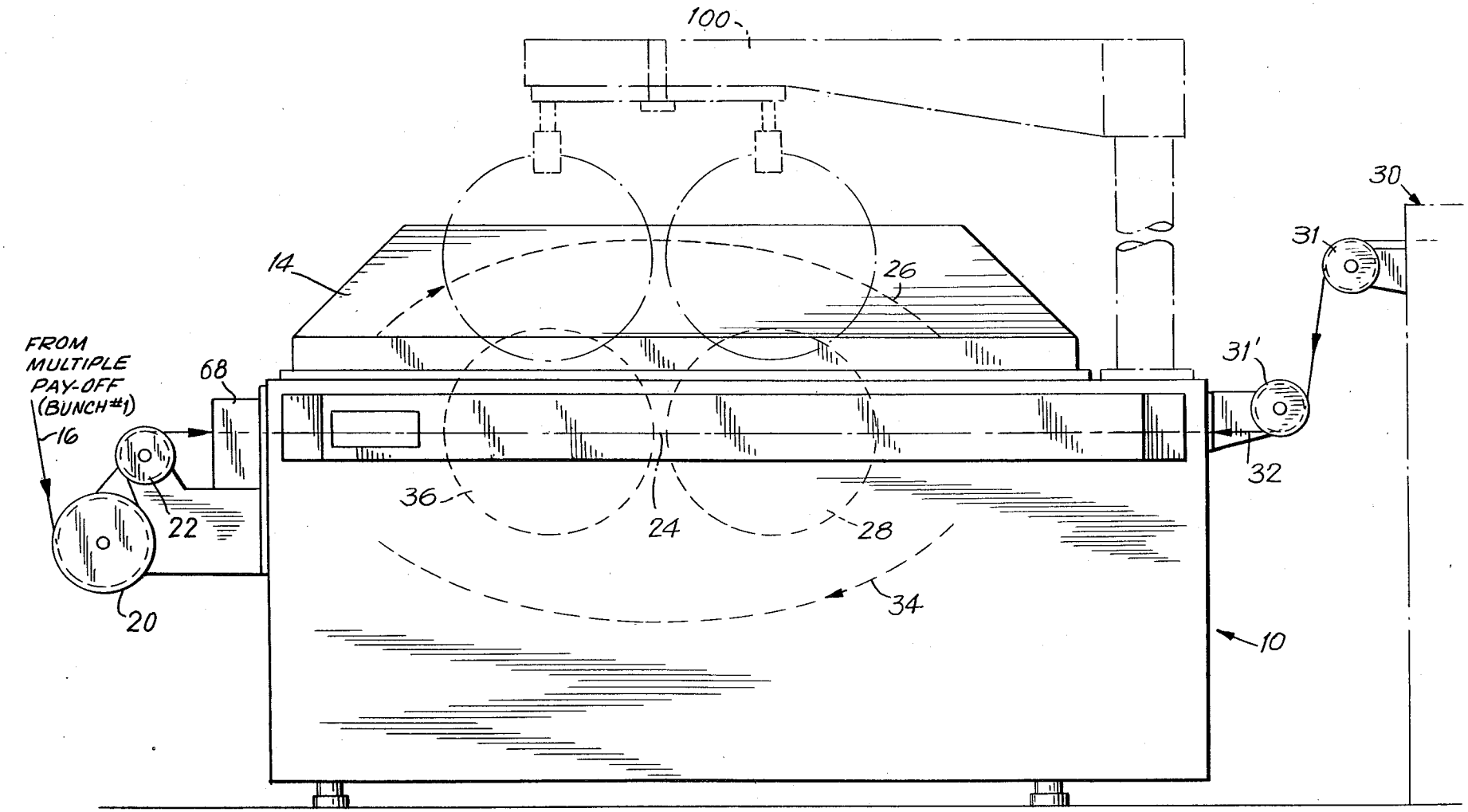
FIG. 1 is a side elevational view of a double twist buncher in accordance with the present invention, showing in phantom outline a load/unload unit that may be used in conjunction with this double twist buncher.

Referring now specifically to the drawings, in which identical or similar parts are designated by the same reference numerals throughout, and first referring to FIG. 1, one presently preferred embodiment of a double twist buncher in accordance with the present invention is designated by the reference numeral 10.

As mentioned above, such machines are sometimes referred to as stranders, bow stranders, twisters, double twist twisters, pairing machines, double twist stranders, twinners, cablers, bunchers, and double twist bunchers. While the term "double twist buncher" will be used herein, the machine may also accurately be referred to by one of the aforementioned terms.

The double twist buncher 10 has a frame or housing 12 which is fixed relative to the ground. The double twist buncher 10 may be provided with a conventional cover 14 to prevent accidental injury or damage while the machine is in operation, as well as to reduce the noise level.

Provided at one end of the double twist buncher 10, the left as viewed in FIG. 1, is a multiple pay-off 16 which provides a group or bunch of wires or strands 18 which are to be twisted about each other. The wires or strands may cooperate with a conventional line speed sensor and/or measuring wheel 20 and subsequently directed to a lay plate closing point apparatus or to a pulley or sheave 22 which is arranged to guide the bunch 18 along the longitudinal axis 24 of the double twist buncher.

Figure 2:
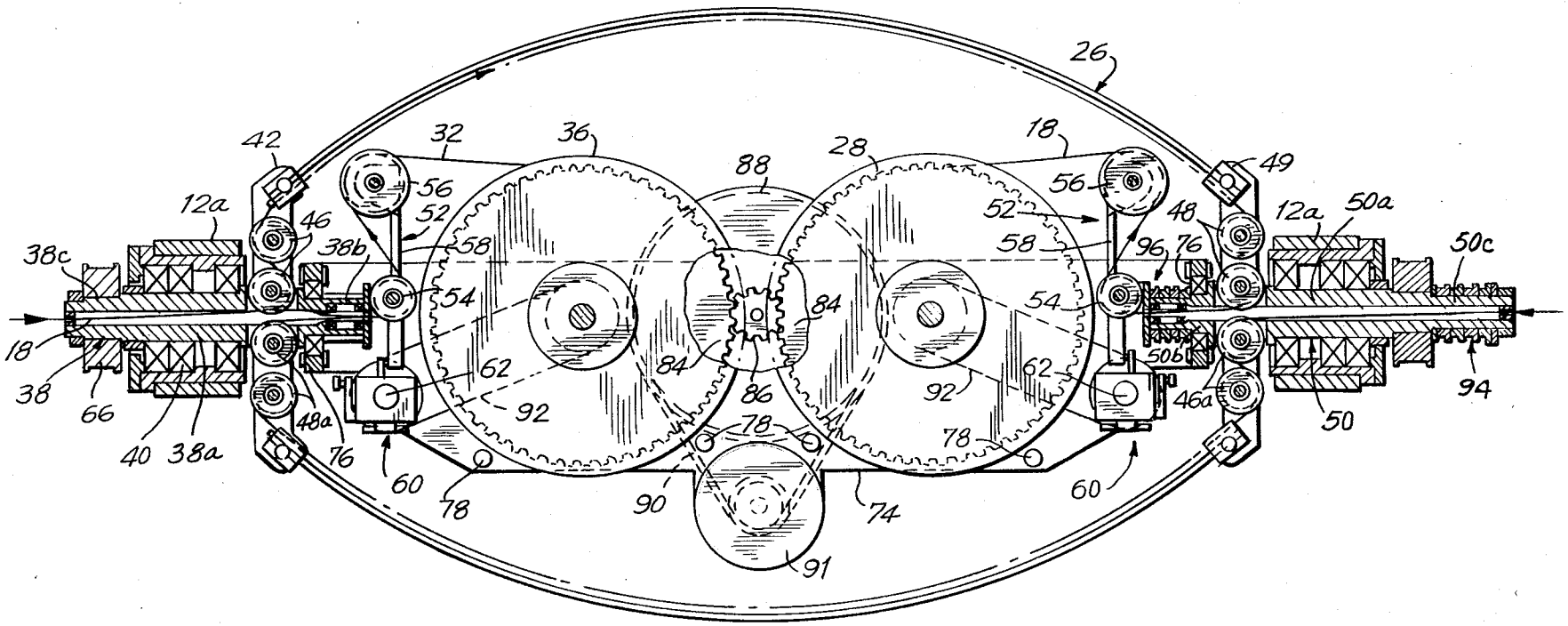
FIG. 2 is a side elevational view of the operative components within the double twist buncher showing the details of one presently preferred embodiment.

Referring to FIGS. 1 and 2, the bunch of wires or strands 18 are guided through a first bow 26 and, as will be more fully described hereafter, is wound onto a first reel 28 after the wires or strands have been imparted a double twist.

Similarly, a second multiple pay-off 30 is disposed at the other end of the machine, to the right as viewed in FIG. 1, which, with the pulleys 31 and 31', directs a second group or bunch of wires or strands 32 into the double twist buncher along its longitudinal axis. The second bunch 32 is imparted a double twist by the bow 34 and subsequently wound onto a second reel 36. Thus, unlike existing machines, the double twist buncher 10 in accordance with the invention accepts multiple wire pay-offs at both longitudinal or axial ends thereof, twists both sets of wires by guiding these wires through another one of the two diametrically opposite bows, and lays each of the twisted sts on one of two reels or bobbins disposed within the machine. Although the use of the idle bow is the preferred embodiment, the same bow could be used, as to be more fully described in connection with FIGS. 6 and 7. It is simply convenient to use the idle bow for this purpose.

More specifically, referring to FIG. 2, the double twist buncher 10 is provided with a hollow shaft 38 at one longitudinal end of the machine, the left as viewed in FIG. 2, which is rotatably mounted within a a set of bearings 40 which are supported within a frame portion 12A which is fixed or secured to the frame 12. The hollow shaft 38 has a middle portion **38*a* which is supported within the bearing 40. An inner extending portion 38*b* of the shaft 38 pivotly supports, by means of a suitable bearing 41, one end of the cradle. At one end of bow 26, bow inlet guide pulleys 46 are mounted on a support arm 42 which is in turn connected to and rotates with the hollow shaft 38. Similarly, bow outlet guide pulleys 48 are mounted on the support arm 49 which itself is mounted for rotation about the longitudinal axis 24 on a hollow shaft 50 at the other end of the double twist buncher. The inlet guide pulleys 46 and outlet guide pulleys 48 are arranged to guide the incoming bunch of wires or strand 18 into one end of the bow 26 and guide said wires or strands, having been twisted once, through the pulleys 48 along the longitudinal axis of the machine and to a traverse mechanism generally designated by the reference numeral 52 which lays or uniformly winds the now double twisted set of strands or wires onto the reel or bobbin 28. The second twist occurs between the final exit pulley 48 and the front traverse sheave 54**.

The traverse mechanism 52 is shown to include pulleys 54 and 56 mounted for rotation on a support member 58 which is mounted for pivoting rotation about the longitudinal axis 24 of the double twist buncher, so that the set of twisted wires or strands 18 is substantially uniformly laid between rims or flanges 28*a* and 28*b* (FIG. 3) of the bobbin or reel 28. The specific traverse mechanism that is used is not critical for purposes of the present invention, and any suitable or conventional traverse mechanism may be used. In the embodiment as shown, the traverse mechanism 52 includes a reversing mechanism 60 which may be a "Uhing" traverse mechanism well known to those skilled in the art. The reversing mechanism 60 is slideably supported on a traverse slide rod 62 and includes means for engaging traverse trip bars or rods 64 which define or limit the traverse. The traverse assembly 52 pivots around the centre line of the machine 24 on a bearing assembly 97. A similar traverse mechanism is provided at each axial end of the machine for laying or winding the twisted sets onto each of the reels 28 and 36 in similar manner.

To rotate the bows 26 and 34, there may be provided drive pulleys 66 fixedly mounted on the outer portions 38*c* and 50*c* of the hollow shafts 38 and 50. The drive pulleys are engaged by belts 68 which are driven by a drive motor 70 by means of an appropriate motor shaft 72. The specific arrangement for rotating the bows is not critical and any known or conventional approach may be used for this purpose.

Figure 3:
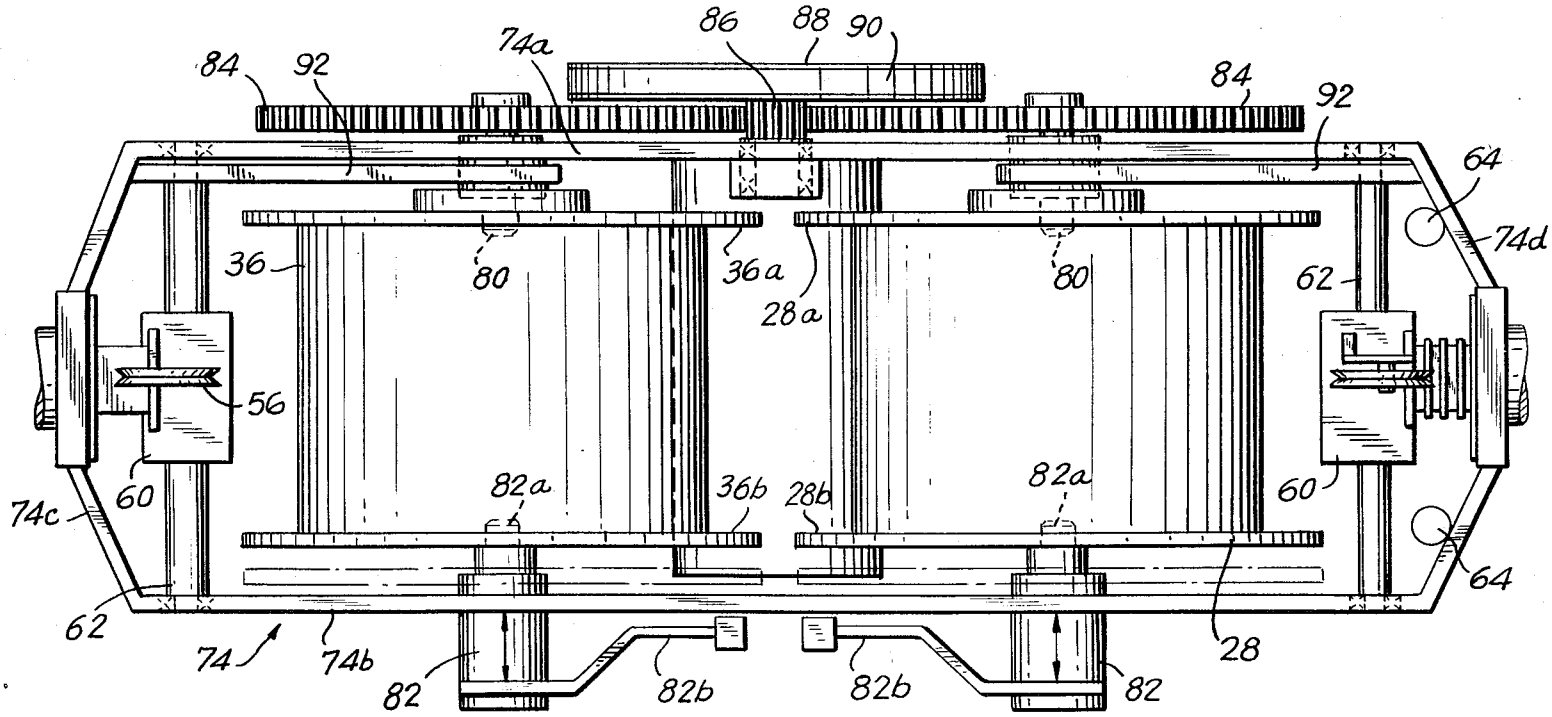
FIG. 3 is a top plan view of the apparatus shown in FIG. 2, with the bows and bearings removed.
Figure 4:
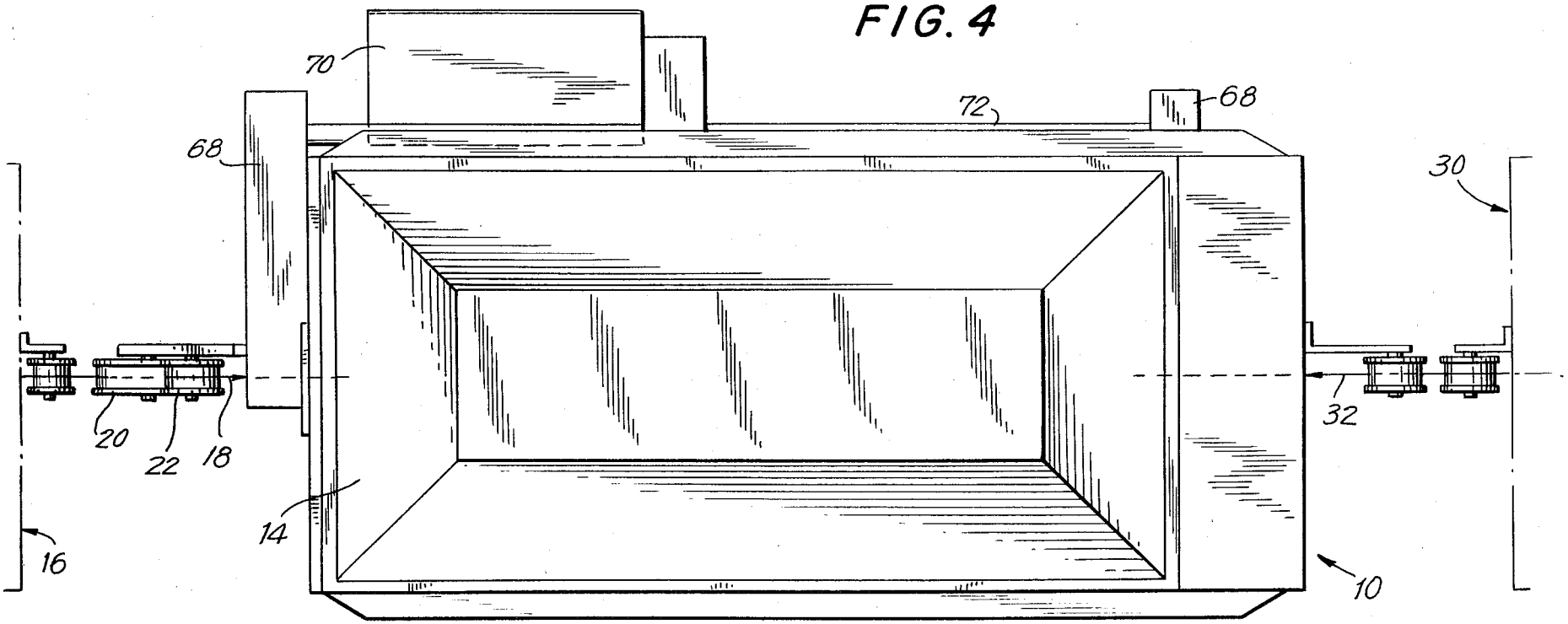
FIG. 4 is a top plan view of the double twist buncher shown in FIG. 1.

Positioned within the space defined by the moveable bows, there is provided a cradle 74 which, as shown in FIG. 3, includes lateral or longitudinal walls 74*a* and 74*b* and transverse or end walls 74*c* and 74*d*. The cradle 74 is mounted on the inner portions 38*b* and 50*b* of the hollow shafts by means of bearings 76. This arrangement permits the cradle to remain stationary relative to the ground when the bows and, therefore, the hollow shafts 38 and 50 rotate. The cradle 74 is normally maintained in a substantially fixed or stationary condition by virtue of the position of its center of gravity relative to the centre line of the machine 24.

Extending between the lateral or longitudinal cradle walls 74*a* and 74*b* are reel location bars 78 (FIG. 2) which position the cradles 28 and 36 to substantially dispose the bores of said bobbins or reels in alignment with the axially stationary pintle shafts 80 rotatably supported on the longitudinal cradle wall 74*a*. Opposite each shaft 80 there is provided a pintle 82 having a moveable pintle shaft 82*a* which is likewise substantially aligned with the bobbin bores when the bobbins are supported on the reel location bars 78. Pintle adjusting arms 82*b* are used to extend the moveable shafts 82*a* into or retract said shafts from the bores of the pintles when the bobbins are initially introduced into the cradle and subsequently withdrawn therefrom.

Each pintle shaft 80 is coupled to a reel driving gear 84, which is externally toothed, the reel driving gears 84 for each of the reels 28 and 36 being meshingly coupled to a gear 86 which is rotatably mounted, by suitable bearing means, on the cradle 74. The idler wheel 88 and, therefore, the gear 86 are rotated by means of a drive belt 90 which is driven by a DC motor 91.

Each of the reel driving gears 84 are also, by means of timing belts 92, used to drive the traverse mechanisms 52.

The DC motor 91, mounted on the cradle 74, is provided electrical power by means of outer slip rings 94 which are electrically connected to inner slip rings 96, both of which form part of the power requirements and control circuit for the motor drives.

The operation of the double twist buncher 10 will now be described. When power is applied to the drive motor 70 for the bows, the belts 68, operating on the drive pulleys 66, rotate the hollow shafts 38 and 50, and with them, the support arms 42 and 49 together with the bows 26 and 34 and the associated inlet and outlet guide pulleys 46, 46*a* and 48 and 48*a*. Groups of wires or strands are drawn from each of the multiple pay-offs 16 and 30 and introduced into each axial or longitudinal end of the machine or double twist buncher 10. The first group or bunch 18 is guided by the inlet guide pulleys 46 into one end of the bow 26.

Similarly, the inlet guide pulleys 46*a*, at the other end of the double twist buncher, guide the second group or bunch of wires or strands 32 into one end of the other bow 34. Having passed through the bow 26, the first group of wires or strands, having been twisted once, are withdrawn from the bow and are received by the outlet guide pulleys 48 which bring the wires or strands along the longitudinal axis 24 of the machine. The second twist occurs between the final exit pulley 48 and the first traverse pulley 54. The wires or strands 18 are evenly distributed onto the winding surface of the bobbin or reel 28 by means of the traverse mechanism 52. The second group of wires or strands 32 is similarly handled except that that group or bunch is introduced at the other longitudinal or axial end of the machine and is guided by the inlet guide pulleys 46*a* into the other bow 34. When the wires are withdrawn from the aforementioned bow the outlet guide pulleys 48*a* bring the set of wires onto the second reel or bobbin 36 by way of a traverse mechanism 52 similar to the one used for the bobbin 28. Activation of the motor 70 for the bows causes the bows to rotate which results in rotation of the slip rings 94, 96 thereby providing electrical power to the DC motor 91. Throughout its operating cycle, actuation of the motor 91 causes rotation of the idler wheel 86 and, therefore, the gear 86 which in turn rotates the wheel driving gears 84. It is the rotation of the bobbins or reels 28, 36 which draw or cause the wire to be payed off from the multiple pay-offs 16, 30. Cooperation through the bow drive and the reel drive through an electric control system provides for the necessary lay control.

Figure 5:
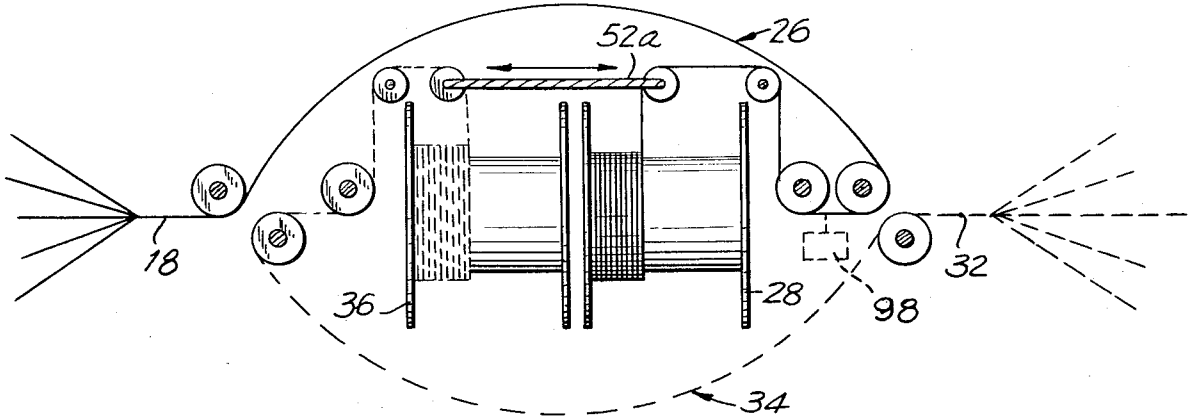
FIG. 5 is a schematic diagram illustrating another embodiment in accordance with the invention.

In the embodiment described in connection with FIGS. 1–4, the bobbins are arranged in spaced relationship along the longitudinal axis 24 with the axes of the bobbins arranged normal to the longitudinal axis 24. Referring to FIG. 5, an alternate embodiment is shown wherein suitable cradle bobbin supporting means may be provided for supporting the bobbins 28, 36 in spaced relationship along the longitudinal axis 24 but with the length direction or axes of the bobbins arranged parallel to and substantially coincident with the longitudinal axis 24 of the cradle. With such an arrangement, as with the other arrangement shown in FIGS. 1–4, a common traverse mechanism 52*a* may be used for simultaneously traversing both bobbins and laying each set of twisted wires on each of the bobbins or an independent traverse can be used. Since the two bobbins share a common traverse, some economies may be achieved in either case.

While the bobbins or reels 28 and 36 have been described as being directly driven in order to effect pay-off from the multiple external pay-offs, it may also be desirable, in some instances, to use a capstan 98 (FIG. 5) which regulates the speed or rate at which the wire is drawn from the external pay-offs. However, the use of a capstan is optional and does not form a critical feature of the invention.

Referring to FIG. 1, there is shown a load/unload unit or apparatus 100 which may be used in conjunction with the double twist buncher of the present invention for simultaneously loading or inserting and for unloading or removing bobbins or reels from the unit. Loading and unloading in this manner may be effected irrespective of whether the bobbins or wheels are arranged with their axes normal to the longitudinal axis 24 (FIGS. 1–4) or with their axes coincident with said longitudinal axis (FIG. 5). The specific arrangements for loading the bobbins is not critical and any known or conventional approach may be used for this purpose.

As will become evident, the double twist buncher in accordance with the present invention provides significant efficiencies and economies. By slightly enlarging single reel double twist bunchers of the "outside-in" type only, two reels or bobbins may be inserted into the unit and production increased almost by a factor of two. However, since the bows have to be somewhat larger, it is estimated that increases in production of 60–70% may be realistically achieved. This increase in production is available for practically the same cost as for a single bobbin machine. Since the drives and controls can be shared for both bobbins, little additional manufacturing expenses need be encountered.

With an arrangement of the type as shown in FIG. 5, wherein the traverse is likewise shared, additional economies may be effected.

The additional benefits and advantages over the prior art or existing twisters are achieved by placing two bobbins within the twister and introducing groups of wires or strands from both axial or longitudinal ends and utilizing the existing bows. However, now the bows are not only used to dynamically balance each other but each bow is additionally used to guide one of the groups or bunches of wires or strands and to impart double twists thereto.

Figure 6:
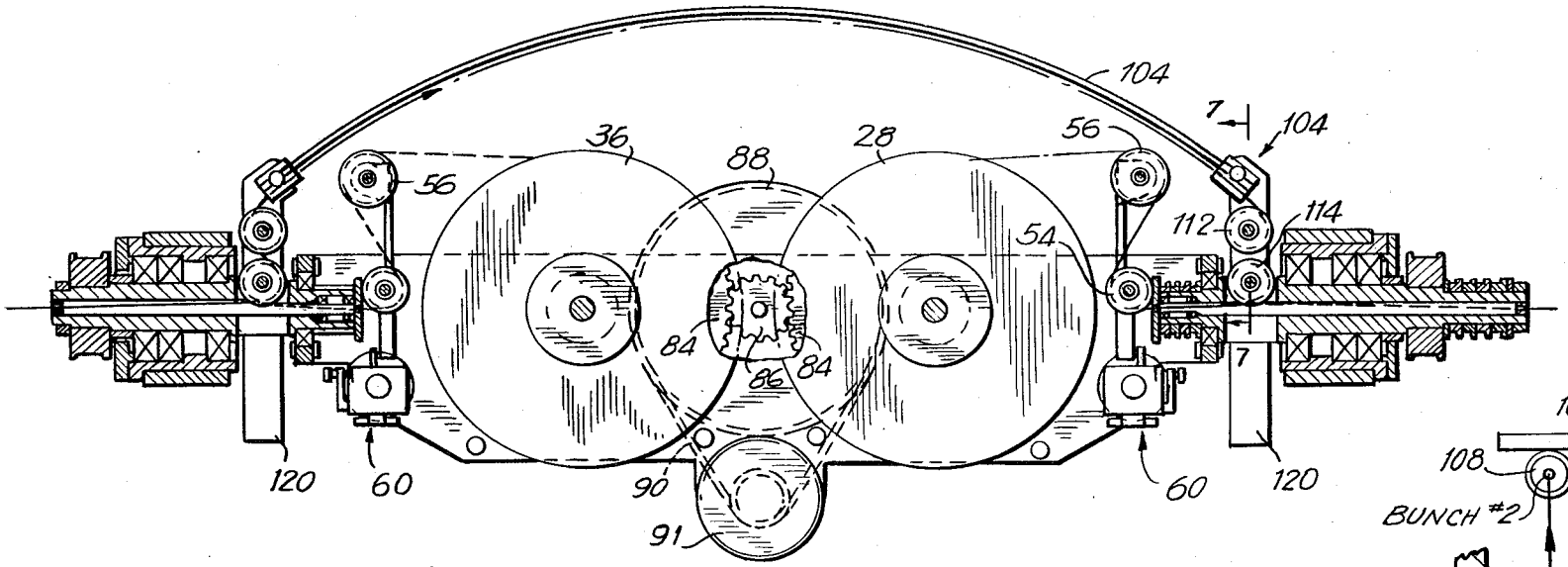
FIG. 6 is similar to FIG. 2, but shows a further emdodiment in accordance with the invention.
Figure 7:
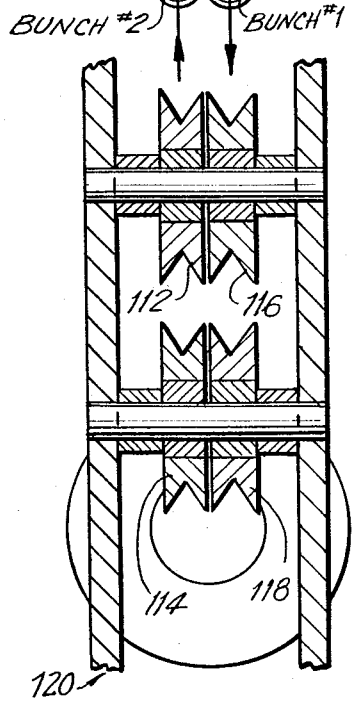
FIG. 7 is an enlarged cross-sectional view of the double twist buncher shown in FIG. 6, taken along line 7—7.

Referring to FIGS. 6 and 7, there is shown a further embodiment of the invention generally designated by the reference numeral 102. In this embodiment, the wire carrier is shown to include a bow 104 with an elongated flat supporting member 106 to which there are attached tubes or conduits 108 and 110, each defining a path or passageway for the groups or wire bunches 1 and 2. The construction shown in FIG. 7 is equivalent to providing two bows arranged co-extensively with each other and mounted for simultaneous rotation about the axis of the machine. The construction and operation of the machine 102 is similar to that previously described in connection with FIG. 2, and all the same or similar components function in the same way to produce the same result. However, when the two wire paths or guides are arranged as shown in FIGS. 6 and 7, an arrangements of pulleys or sheaves as shown in FIG. 7 is provided. Thus, the conduit or tube 108 cooperates with pulleys or sheaves 112, 114 for guiding the group or bunch of wires from the pay-off at one axial end of the machine, the right side as viewed in FIG. 6, for introduction into the conduit or tube 108. However, there is advantageously provided a second set of pulleys or sheaves 116, 118 mounted on the same supporting shafts that support the pulleys 112, 114. The two sets of pulleys, namely, 112, 114 and 116, 118 are arranged so as to be aligned with the conduits or tubes 108, 110, respectively. The set of pulleys 116, 118 are arranged to receive and guide the group or bunch of wires leaving the conduit or tube 110 to direct the wires axially inwardly into the machine for cooperation with the guide wheels 54, 56 as described previously. Similar sets of pulleys or sheaves are provided at the other axial end of the machine, the left side as viewed in FIG. 6, to perform the similar functions at that end.

For the embodiment of FIG. 6 and 7, there are advantageously provided counterweights 120 which are disposed generally diametrically opposite to the wire carrier 104 so as to dynamically balance the wire carrier during rotation of the same about the longitudinal axis in the machine.

The embodiment shown in FIG. 6 and 7 shares the common feature with the other previously described embodiments that the two groups or bunches of wires or strands are introduced at opposite axial ends of the machine. The specific arrangement of the wire carriers or bows or the wire paths once the wires enter into the machine is not critical and, as will be clear from the previous descriptions of a number of embodiments, different arrangements can be used to achieve the same or similar results. For example, the wire or strands can be introduced at opposite axial ends of the machine and introduced into two separate wire carriers or bows which are arranged to be rotated in opposite directions so as to provide the same twist sense to both of the groups of wires or strands. This may be achieved by providing slightly different sized bows and appropriate drives.

While preferred embodiments of the invention have been shown and described, various other embodiments and modifications will become apparent to persons skilled in the art, and will fall within the scope of the invention as defined in the claims that follow.

What is claimed is:

1. A twin bobbin bow double twist buncher comprising: a frame; a cradle mounted on said frame defining a longitudinal axis of the double twist buncher and including means for supporting two wire receiving bobbins proximate to each other, said cradle being provided with bobbin engaging means for selectively engaging the bobbins prior to winding of wire thereon and disengaging the same when said bobbins are full with wire and are to be removed from the double twist buncher; first and second bearing means provided at each axial end of said cradle; first and second wire carrier means mounted on respective bearing means for rotation about said longitudinal axis of said cradle for movement relative to said frame, cradle and bobbins, each wire carrier means defining a wire path extending substantially between said bearing means; first inlet guide means disposed proximate said first bearing means for receiving a first group of wires or strands to be twisted, said first inlet guide means being mounted for rotation together with said first wire carrier means about said longitudinal axis, said first inlet guide means being positioned to guide the first group of wires or strands into one end of said first wire carrier means; second inlet guide means disposed proximate said second bearing means for receiving a second group of wires or strands to be twisted, said second inlet guide means being mounted for rotation together with said second wire carrier means about said longitudinal axis, said second inlet guide means being positioned to guide the second group of wires or strands into one end of said second wire carrier means; first outlet guide means disposed proximate the other end of said first wire carrier means for receiving the wires or strands from said first wire carrier means and guiding the same proximate to a first bobbin; second outlet guide means disposed proximate the other end of said second wire carrier means for receiving the wires or strands from said second wire carrier means and guiding the wires or strands proximate to a second bobbin; traverse means for traversing the axial lengths of the bobbins and laying the first and second groups of wire to be respectively wound onto the bobbins; drive means for driving said wire carrier means and bobbins; and control means for controlling the operation of said drive means, whereby each group of wires or strands introduced at an opposite axial end of the buncher is imparted a first twist at a respective inlet guide means and imparted a second twist between associated outlet guide and traverse guide means and laid on an associated bobbin.

2. A twin bobbin double twist buncher as defined in claim 1 wherein said cradle bobbin supporting means comprises means for supporting the bobbins in spaced relationship along said longitudinal axis of said cradle.

3. A twin bobbin double twist buncher as defined in claim 2, wherein said traverse mens comprises separate traverse mechanisms at each axial end of said cradle ech for traversing an associated bobbin and laying one set of twisted wires or strands thereon.

4. A twin bobbin double twist buncher as defined in claim 2, wherein said drive means comprises a first drive for rotating said wire carrier means, about said longitudinal axis and a second drive for rotating the two bobbins about their respective axes.

5. A twin bobbin double twist buncher as defined in claim 1, wherein said cradle bobbin supporting means comprises means for supporting the bobbins in spaced relationship along said longitudinal axis with the length directions or axes of the bobbins arranged parallel to and substantially coincident with said longitudinal axis of the cradle.

6. A twin bobbin double twist buncher as defined in claim 5, wherein said traverse means comprises a common traverse mechanism for simultaneously traversing both bobbins and laying one set of twisted wires on each of the bobbins.

7. A twin bobbin double twist buncher as defined in claim 5, wherein said drive means comprises a first drive for rotating said wire carrier means about said longitudinal axis and a second drive for rotating the two bobbins about their respective axes.

8. A twin bobbin double twist buncher as defined in claim 1, wherein said first and second carrier means comprise bows.

9. A twin bobbin double twist buncher as defined in claim 1, wherein said first and second wire carrier means are arranged diametrically opposite to each other in relation to the longitudinal axis of the buncher.

10. A twin bobbin double twist buncher as defined in claim 1, wherein said first and second wire carrier means are coextensive with each other and rotate together about the longitudinal axis of the buncher.

11. A twin bobbin double twist buncher as defined in claim 10, further comprising counterweights to counterbalance the effects of said wire carrier means during rotation thereof.

12. A twin bobbin double twist buncher as defined in claim 1, further comprising capstan means disposed within the double twist buncher for drawing the wires or strands through said inlet guide means at predetermined speeds.

13. A twin bobbin double twist buncher as defined in claim 1, further comprising loading and unloading means for introducing two empty bobbins into the double twist buncher and removing said two bobbins when filled with twisted wires or strands.

14. A twin bobbin double twist buncher as defined in claim 1, in combination with a first multiple pay-off at one longitudinal end of the double twist buncher for paying-off said first group of wires and strands, and a second multiple pay-off at the other longitudinal end of the double twist buncher for paying-off said second group of wires and strands.

* * * * *